US006200656B1

(12) United States Patent
Tsang

(10) Patent No.: US 6,200,656 B1
(45) Date of Patent: Mar. 13, 2001

(54) ARTIFICIAL TREE

(75) Inventor: Kwok Choi Tsang, Hong Kong (HK)

(73) Assignee: Wellpak Technical Development Limited, Kwai Cheong (HK)

( * ) Notice: Subject to any disclaimer, the term of this patent is extended or adjusted under 35 U.S.C. 154(b) by 0 days.

(21) Appl. No.: 09/325,414

(22) Filed: Jun. 4, 1999

(30) Foreign Application Priority Data

Dec. 18, 1998 (HK) ..... 9811619

(51) Int. Cl.[7] ..... A41G 1/00

(52) U.S. Cl. ..... 428/20; 428/542.8; 428/9; 428/18; 428/12; 493/956

(58) Field of Search ..... 428/17, 18, 19, 428/15, 12, 20, 542.8, 9; 493/956, 340; 40/800

(56) References Cited

U.S. PATENT DOCUMENTS 1,162,230 * 11/1915 Foster .
2,395,578 * 2/1946 Pergande .
3,677,867 * 7/1972 Westlund .
3,931,948 * 1/1976 Mason, Jr. .
4,746,022 * 5/1988 Benham .
5,085,901 * 2/1992 Johnson et al. .
5,486,386 * 1/1996 Rovsek .

OTHER PUBLICATIONS

Merriam–Webster's Coillegiate Dictionary–10th ed., 1999 (No Month), p. 1105.*

* cited by examiner

*Primary Examiner*—Deborah Jones
*Assistant Examiner*—Wendy Boss
(74) *Attorney, Agent, or Firm*—Greenblum & Bernstein, P.L.C.

(57) ABSTRACT

According to the present invention, an artificial tree is provided which includes a tree element having a central generally disc-shaped member and a plurality of generally annular rings concentric to the central disc-shaped member and to one another such that the central disc-shaped member and the rings, in the operative position, are positioned in a vertically spaced, tiered array, with the central disc-shaped member at an uppermost position such that the tiered array is configured to have a tree-shape. A plurality of connecting strips connect each tier of the array to a next adjacent tier of the array. The disc-shaped member, the concentric rings, and the connecting strips may be formed from a unitary sheet of material, and the disc-shaped member and the concentric rings may be formed by providing a plurality of discontinuous generally spiral slits in the sheet of material. The tree may also include a central pole adapted to be fixed at one end to the disc-shaped member for supporting the tree element in an operative position, and the pole may be configured at one end with a pointed end which may be pushed into the ground. Alternatively, a stand adapted to receive the lower end of the pole may be provided for supporting the tree-shaped device in a conventional manner. The tree may also include a centering device which is adapted to engage at least one of the rings and to cooperate with the pole to center a lower portion of the tiered array with respect to the pole to thereby maintain the balance of the tree. A blank may be provided for forming the tree element, and may be formed of a sheet of relatively rigid, resilient material provided with the plurality of generally concentric, spaced arrays of discontinuous generally spiral slits.

20 Claims, 10 Drawing Sheets

ARTIFICIAL TREE

BACKGROUND OF THE INVENTION

1. Field of the Invention

The present invention relates to an artificial tree, such as an artificial Christmas tree, which is easy to assemble and disassemble, and when disassembled occupies a small amount of space which facilitates storage.

2. Description of Background Information

Artificial trees, such as artificial Christmas trees, have been known for many years and have been formed in various manners. In particular, such artificial trees are known to be formed from a number of natural and synthetic materials to provide individual branches which may be removably mounted or hingedly mounted to a central pole resembling a tree trunk. These known trees are thus disassembled by removing the branches or collapsed by folding the branches. However, such known trees are often difficult to assemble and disassemble, or assembly and disassembly is time consuming, and/or the disassembled condition of the tree occupies a large amount of space making storage difficult and costly.

SUMMARY OF THE INVENTION

Accordingly, the present invention relates to a relatively problem-free, readily assembled artificial tree such as a Christmas tree. The artificial tree of the present invention can be quickly assembled, often in as little time as 30 seconds, and can be equally quickly disassembled. Furthermore, upon disassembly, the artificial tree of the present invention occupies a relatively compact space which is significantly smaller than previously known artificial trees. Thus, the artificial tree of the present invention is also easy to store.

According to a first aspect of the present invention, a tree element or tree-shaped device is provided which includes a central generally disc-shaped member and a plurality of generally annular rings, with the rings being concentric to the central disc-shaped member and to one another. The central disc-shaped member and the rings, in the operative position, are positioned in a vertically spaced, tiered array, with the central disc-shaped member at an uppermost position such that the tiered array is configured to have a tree-shape. A plurality of connecting strips connect each tier of the array to a next adjacent tier of the array. Moreover, the outer perimeter of each ring, in a lower next adjacent tier of the array, is greater than that of the ring positioned thereabove, and the inner perimeter of each ring in a lower next adjacent tier of the array is about the same dimension as the outer perimeter of the ring position there above.

In another aspect of the invention, the disc-shaped member and the concentric rings may be formed from a unitary sheet of material. The material may be any thin sheet of material suitable for forming such a tree-shaped device, including paper, paper board, cardboard, synthetic plastic material, metallic material such as aluminum, or any other suitable material. According to a preferred embodiment of the invention, the material forming the tree-shaped device is formed from a thin sheet of synthetic plastic material.

According to another aspect of the invention, the plurality of connecting strips which connect each tier of the array to a next adjacent tier are formed from the same unitary sheet of material from which the disc-shaped member and the concentric rings are formed. Additionally, the disc-shaped member and the concentric rings may be formed by providing a plurality of discontinuous generally spiral slits in the sheet of material between the generally disc-shaped member and a next adjacent ring, and between each respective adjacent ring, to define the outer perimeters of the generally disk-shaped member and each of the concentric rings, except for an outermost ring, and also to define the inner perimeters of each concentric ring. Additionally, the plurality of discontinuous generally spiral slits also define the plurality of connecting strips. Furthermore, the unitary sheet of material may be formed as a thin circular sheet of material.

In another aspect of the present invention, the artificial tree may further include a central pole adapted to be fixed at one end to the disc-shaped member for supporting the tree-shaped device in an operative position. However, the tree-shaped device may be supported in its operative position by any appropriate means, such as by suspending the disc-shaped member from above, such as by hanging. Additionally, the pole may be configured at one end to facilitate insertion into a support surface. For example, the pole may have a tapered or pointed end whereby the plie may be positioned merely by pushing the pointed end of the pole into the ground. Alternatively, a stand may be provided having radiating legs and a central support member to receive the lower end of the pole for supporting the tree-shaped device in a conventional manner.

According to a further aspect of the invention, the artificial tree may further include a centering device which is adapted to engage at least one of the rings and to cooperate with the pole to center a lower portion of the tiered array with respect to the pole to thereby maintain the balance of the tree. Furthermore, the centering device may include a circular portion for engagement with the lower portion of the tiered array, a central member for engaging the pole, and a plurality of spacer elements extending radially between the circular portion and the central member.

According to another aspect of the present invention, a blank is provided for forming a tree-shaped device. The blank is formed of a sheet of relatively rigid, resilient material that is provided with a plurality of generally concentric, spaced arrays of discontinuous generally spiral slits. The spaced arrays of slits define a central, generally circular disc-shaped member, a plurality of generally annular rings, and a plurality of spirally arranged hinge strips unitarily formed between adjacent ones of the generally disc-shaped member and each of the generally annular rings. Thus, the generally disc-shaped member and at least one ofthe generally annular rings are capable of being moved away from one another to form a vertically spaced tiered array with the hinge strips providing the spacing between the tiers of the tiered array. The sheet of relatively rigid, resilient material may be formed as a thin, generally circular disc. Furthermore, the generally circular disc may be formed from any suitable material and preferably is formed from a thin sheet of synthetic plastic material. Furthermore, each slit of each of the spaced arrays of spiral slits overlaps another slit of each spaced array of spiral slits.

In another aspect of the present invention, a method of making a display device is provided. The method includes providing a sheet of relatively rigid, resilient material, providing the sheet with a plurality of generally concentric spaced arrays of discontinuous generally spiral slits arranged to define a central, generally circular disc-shaped member, a plurality of generally annular rings, and a plurality of spirally arranged hinge strips between adjacent ones of the generally disc-shaped member and each said annular ring. The method also includes moving the generally disc-shaped member and at least one of the generally annular rings away from one another to form a generally conically shaped, vertically spaced tiered array. The method may further include providing the slits in each spaced array of the spiral slits to overlap with at least one other slit in each spaced array.

BRIEF DESCRIPTION OF THE DRAWINGS

The above and other features and advantages of the present invention will become apparent from the following description of the preferred embodiments, given as non-limiting examples, with reference to the accompanying drawings, in which.

DETAILED DESCRIPTION OF THE PREFERRED EMBODIMENTS

Figure 1:
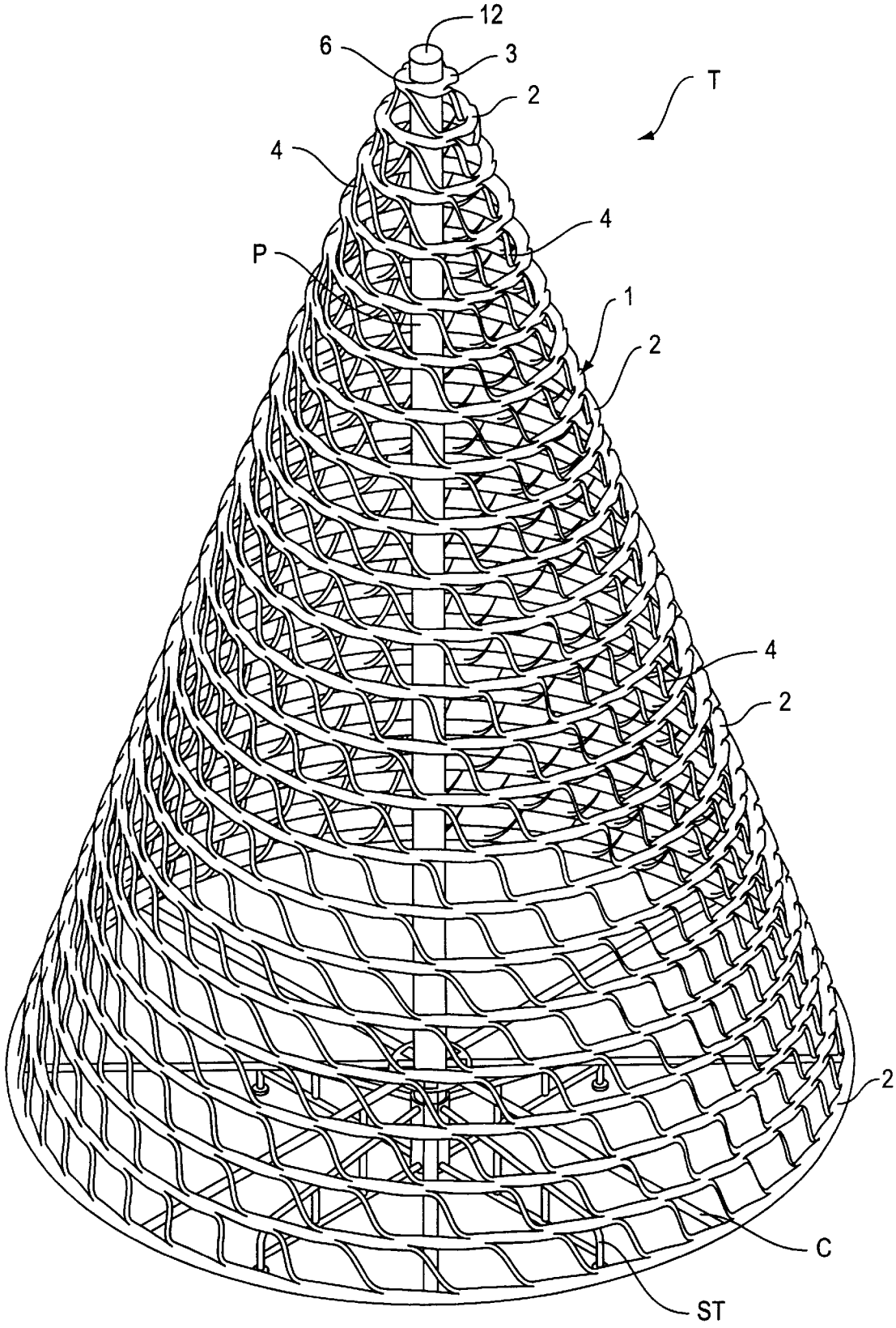
FIG. 1 shows a front perspective view of the artificial tree according to a first embodiment of the present invention.
Figure 2:
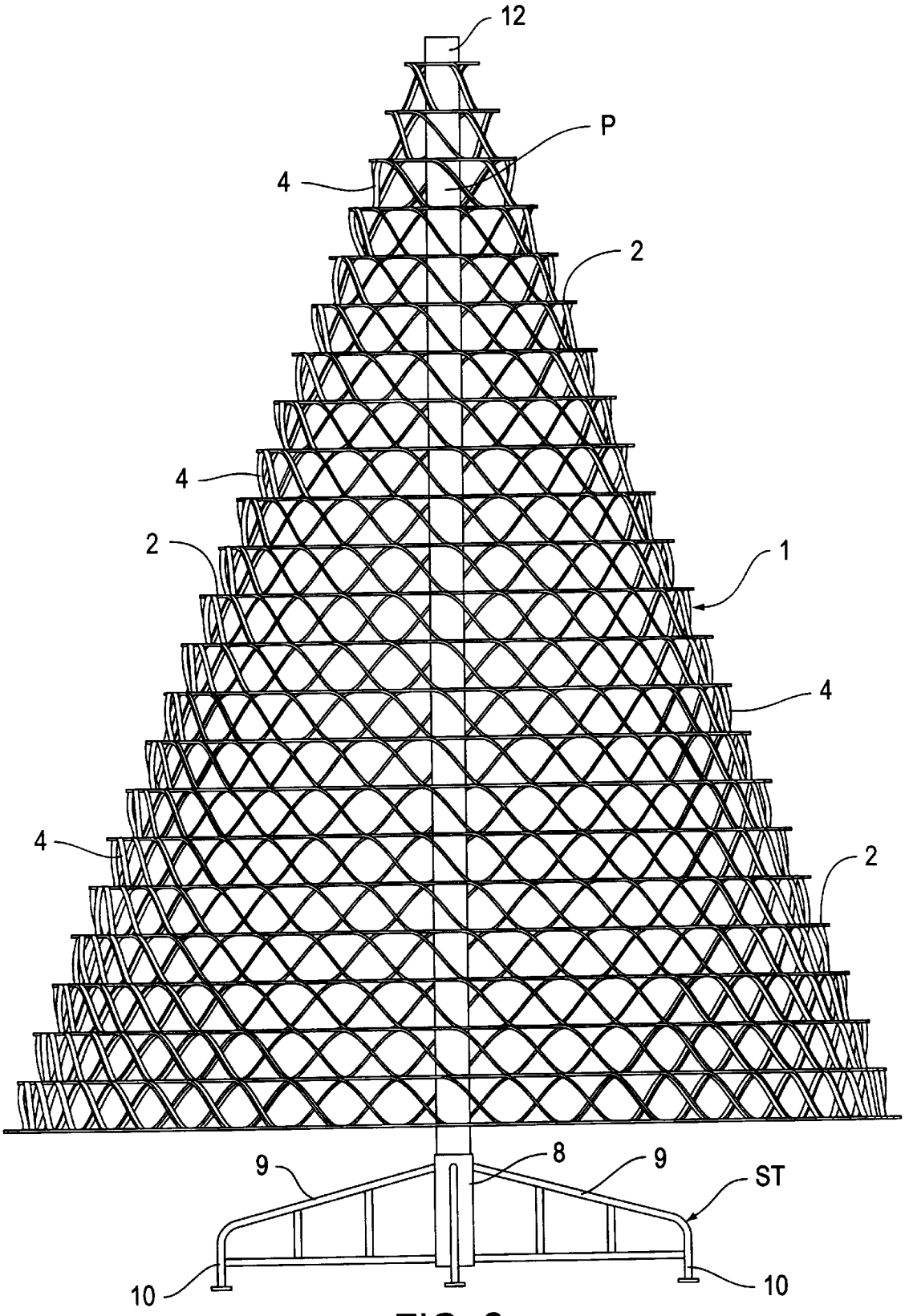
FIG. 2 shows a front elevational view of the artificial tree of the first embodiment of the present invention.
Figure 3:
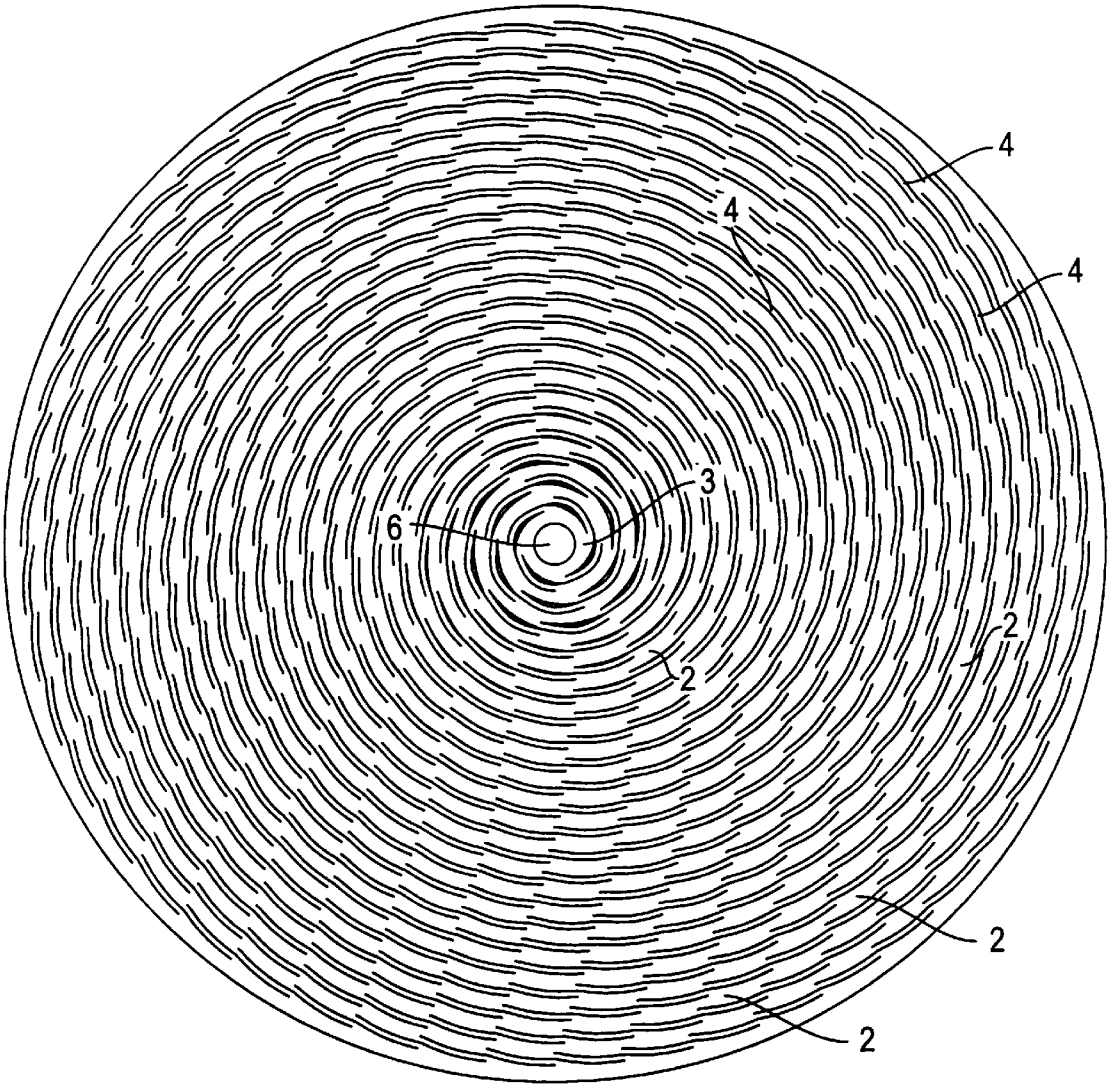
FIG. 3 shows a top plan view of the first embodiment of the present invention.

The embodiments of the present invention will now be described with respect to the accompanying figures. In a first embodiment of the present invention, a tree T such as a Christmas tree is depicted in FIGS. 1 and 2. The tree T is formed to have a generally conical shape and includes a tree element or tree-shaped device 1. The tree element 1 is formed from an upper central, generally circular disc-shaped member 3, a plurality of generally annular rings 2, and a plurality of connecting strips 4 which connect the disc-shaped member 3 to a next adjacent annular ring 2 and which connect successive annular rings 2 to one another to form a vertically spaced, tiered array, with the central disc-shaped member 3 at an uppermost position such that the tiered array is configured to have a tree-shape as apparent from viewing FIGS. 1 and 2.

Figure 17:
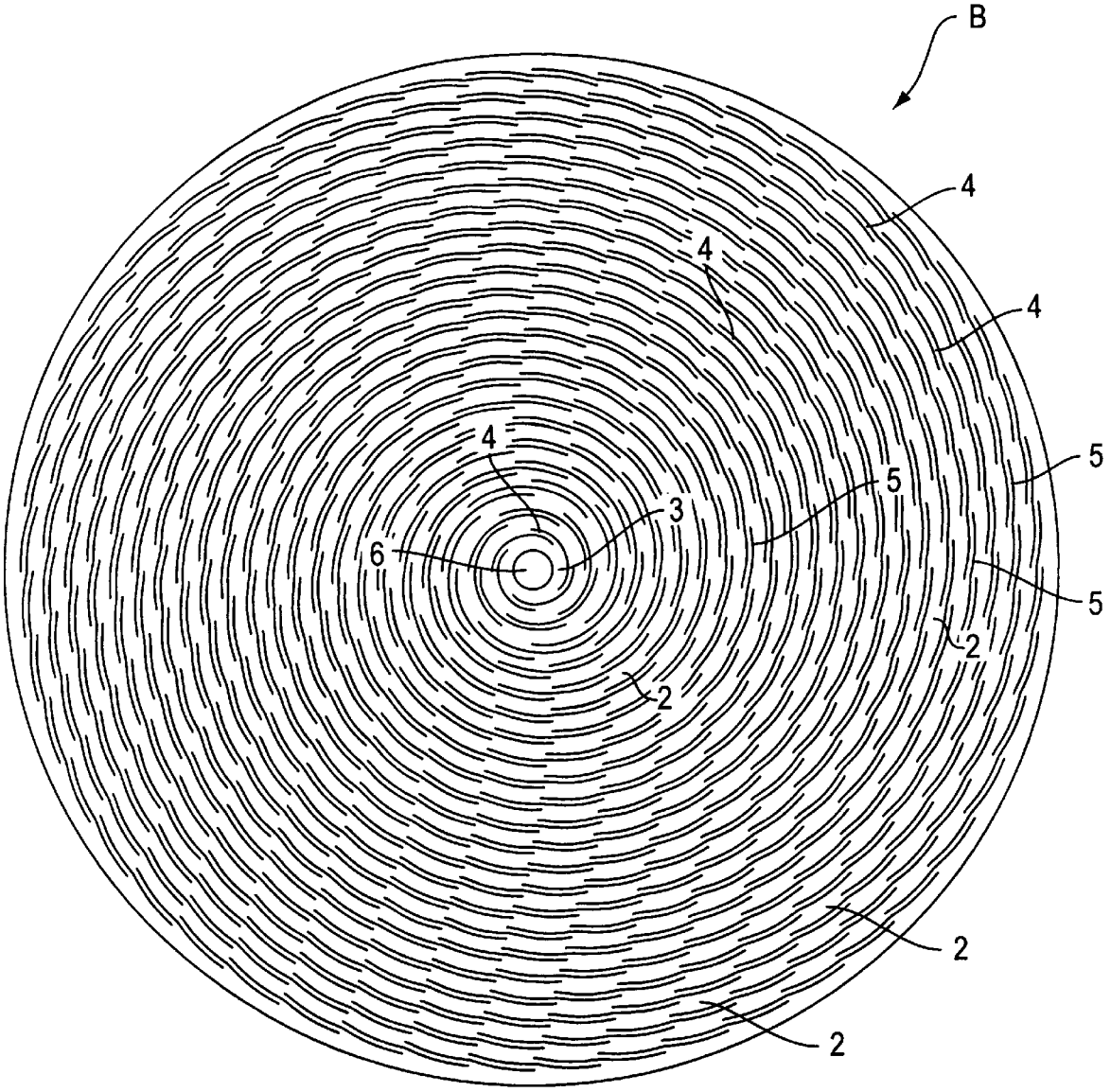
FIG. 17 is a plan view of the blank for forming a tree element or tree-shaped device of the present invention.

Referring to FIG. 17 of the drawings, a blank B is shown which is used to form the tree element or tree-shaped device 1 of the present invention. The blank B is formed in any desirable shape, and in a preferred embodiment is configured as a generally circular disc of thin sheet material. The blank B can have any suitable size, and in a preferred embodiment, a circular disc having a diameter of about 122 cm is provided.

As can be seen from FIG. 17, the blank B includes a central circular opening 6 and a plurality of generally concentric, spaced arrays of discontinuous generally spiral slits 5. A generally circular disc-shaped member 3 is formed at the center of the blank by a first array of slits 5 which includes four generally spirally arranged and partially overlapping slits 5 which form four generally spirally arranged connecting strips or hinge strips 4 which connect between the disc-shaped member 3 and a first generally annular ring 2. A plurality of generally concentric spaced arrays of discontinuous generally spiral slits are arranged at a plurality of radially spaced locations extending from the generally disc-shaped member toward the outer periphery of the blank B as clearly seen in FIG. 17.

It should be noted that FIG. 17 shows four slits forming the first array, six slits are shown forming the second array, eight slits are shown forming the third array, etc. The particular number of slits 5 used to form each array may be selected to be any number but it should be noted that the length of the slits and the amount of overlap between the slits in each array determines the length of the connecting strips 4 and hence the spacing between the tiers as seen in FIG. 2. Accordingly, to provide uniform spacing between adjacent tiers of the generally annular rings 2, the connecting strips 4 should have a generally uniform length throughout the blank B as seen in FIG. 17. However, the overlap of the slits 5 in each spaced array may be varied, as can the length of the overlap of the slits 5 from one array to the next, which would result in greater spacing between different tiers of annular rings 2 and/or a nonparallel arrangement of the annular rings 2.

While the arrays of slits 5 may be formed to have any desired spacing, in the preferred embodiment described above formed from the 122 cm diameter disc, the spacing between the slits 5 of each array of slits results in connection strips 4 having a width (in the radial direction of the blank B) of about 9 cm. Furthermore, in the embodiment illustrated in FIGS. 1–4, a total of 22 spaced arrays of slits 5 are provided, which results in a total of 23 tiers in the tiered array of disc-shaped member 3 and generally annular rings 2 (as shown in FIGS. 1 and 2). However, any desired number of tiers can be selected.

The blank B may be formed from any suitable materials such as paper, paper board, corrugated cardboard, metal sheeting, or synthetic plastic sheet material. The sheet of material forming the blank B should be a relatively rigid, yet resilient, material and may have any suitable thickness. Furthermore, the diameter of the blank B is dependent upon the ultimate height of the tree-shaped device desired. Moreover, the sheet of material forming the blank B is preferably die-cut to form the plurality of generally concentric, spaced arrays of discontinuous generally spiral slits 5, such as the pattern shown in FIG. 17, so that the central disc-shaped member 3 can be pulled up like a spiral to form the tree element 1 depicted in FIGS. 1 and 2.

However, the slits 5 may be formed in any known manner, such as by sawing, cutting, or by the use of a laser cutting device. Thus, it can be seen, particularly by observing FIGS. 1 and 2, that the spacing of the plurality of generally annular rings 2 by the connecting strips 4 forms a tree element or tree-shaped device 1 that is relatively "see through" and upon which lighted and/or unlighted ornaments may be provided such that the ornaments are all visible even when viewing from only one side of the tree element.

As seen in FIGS. 1 and 2, a central pole P may be provided to support the tree element 1 in the operative position. However, any suitable mechanism for supporting the tree element 1 can be utilized, such as by suspending the tree element 1 from an overhead support. In the embodiment illustrated in FIGS. 1 and 2, the pole P is depicted as a one piece pole, but the pole P can also be formed from a plurality of sections, including a plurality of hinged sections, a plurality of telescoping sections, or a plurality of disconnectable sections that can be erected to form the pole P and can be collapsed to provide a more compact arrangement for storage. The pole P, or the elements forming the pole P, can be formed from any suitable material such as wood, metal, or synthetic plastic material, and may be formed as a solid member or as a hollow member to reduce weight. In a preferred embodiment, the pole P is formed as two interfitting pieces of tubular aluminum material in a known manner (not shown) to reduce the weight thereof and to allow easy disassembly thereof for storage purposes. The pole P may also be formed to be length adjustable in any known manner such as by locking telescoping section, by a plurality of interfitting pieces. In a preferred embodiment, the pole P is adjustable from about 5 feet to about 7.5 feet.

Additionally, a stand ST may be provided to receive the lower end of the pole P to support the tree element in the operative position, as seen in FIGS. 1 and 2. The stand ST is shown to have a central tubular portion 8 and a plurality of radiating leg sections 9, of which four are shown in the drawings, but any suitable number of leg sections 9 may be utilized. The leg sections 9 may terminate in feet 10, as shown in FIG. 2. The stand ST may be formed of any suitable material, for example steel, aluminum, cast iron or synthetic plastic material. Additionally, any conventional Christmas tree stand could be utilized to support the pole P to retain the tree element 1 in the operative position.

Figure 5:
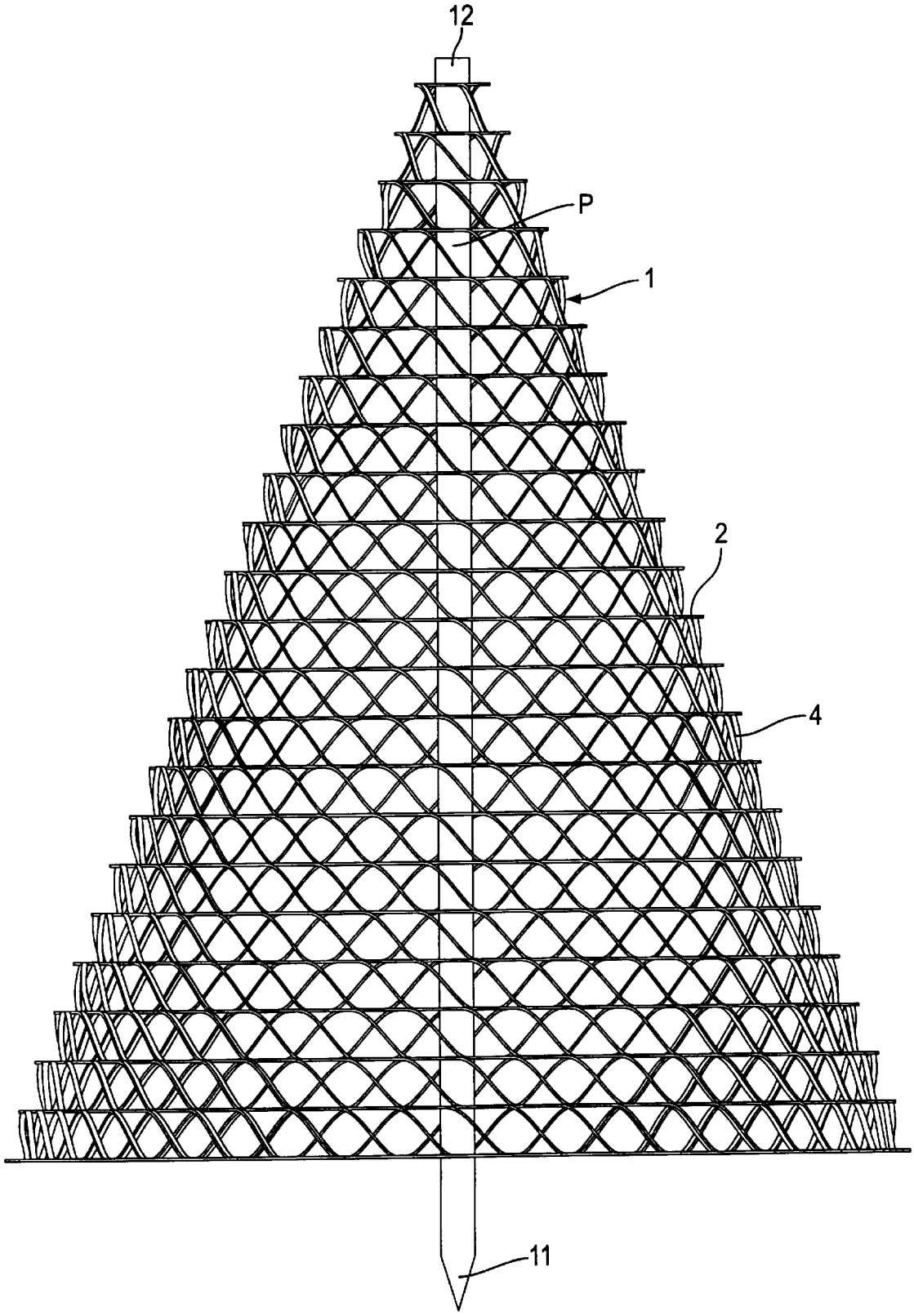
FIG. 5 shows a side elevational view according to a second embodiment of the present invention.

In a second embodiment of the present invention, the pole P can be configured to have a tapered or pointed end at the lower end 11 thereof as shown in FIG. 5. This tapered or pointed lower end 11 which not only facilitates insertion of the lower end of the pole P into the tubular portion 8 of the stand ST, but if it is desired to utilize the tree T and pole P without the stand ST, the pointed lower end 11 of pole P can be pushed directly into a yieldable supporting surface, such as the ground.

The upper end of the pole 12 of the pole P is configured to enter the circular opening 6 of the disc-shaped member 3 and to retain the disc-shaped member 3 in a supported position at the upper end of pole P. To this end, the upper end 12 of the pole may have a tapered configuration, or the upper end 12 may have a smaller diameter than the remainder of the pole P to define a shoulder to retain the disc-shaped member 3 in position at the upper end of the pole P (neither of which is depicted in the drawings).

Figure 4:
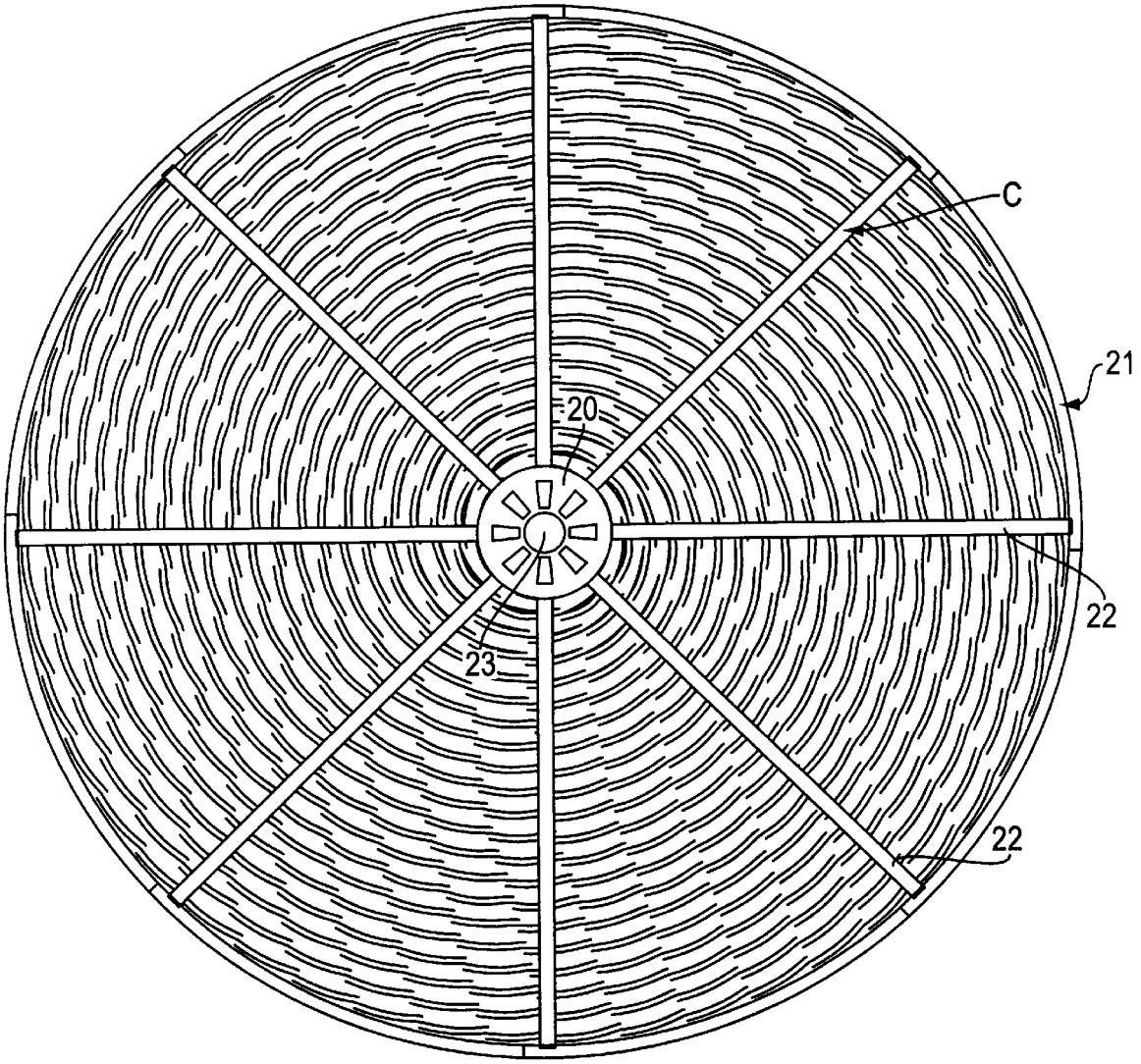
FIG. 4 shows a bottom plan view of the first embodiment of the present invention with the stand omitted for clarity.
Figure 6:
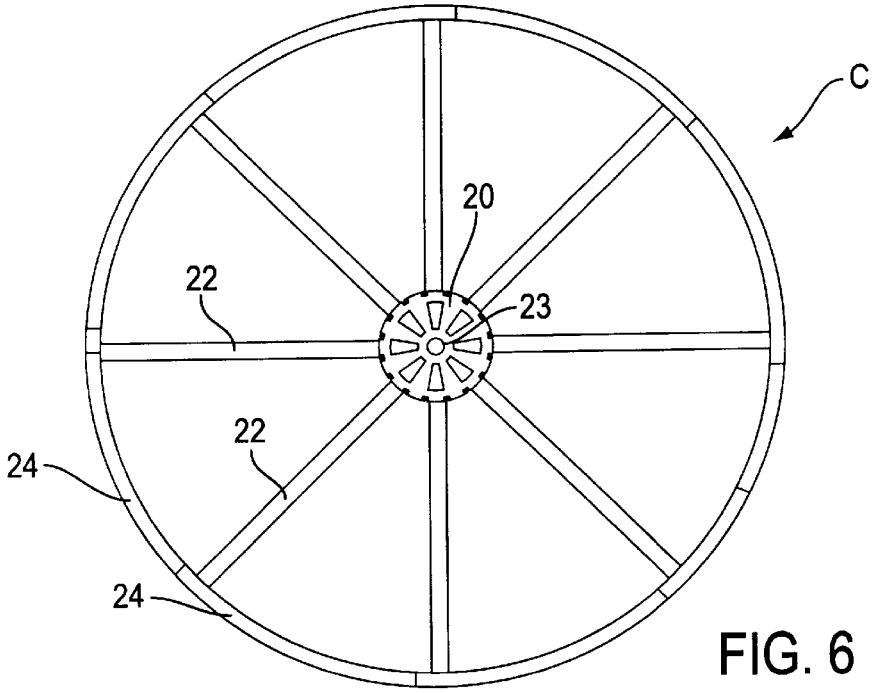
FIG. 6 shows a top plan view of the centering device of the present invention.
Figure 7:
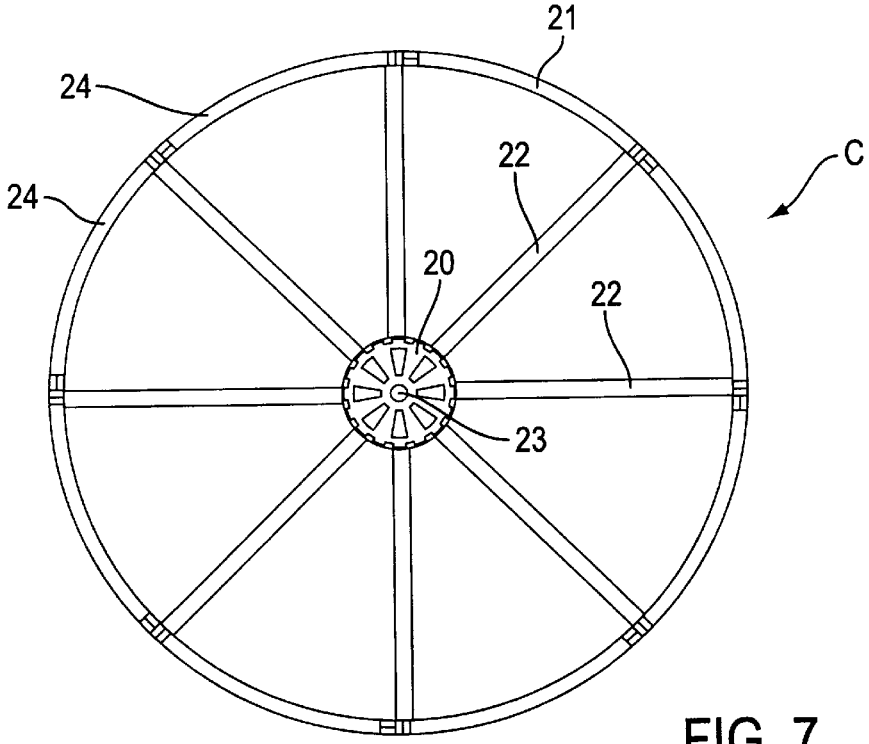
FIG. 7 shows a bottom plan view of the centering device of the present invention.
Figure 8:
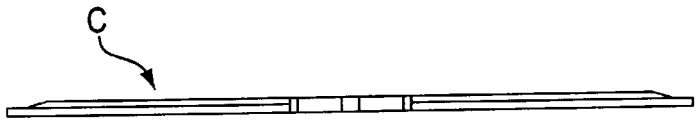
FIG. 8 shows a side elevational view of the centering device of the present invention.

In order to balance the tree element T with respect to the pole P, a centering device C is provided as seen in FIGS. 1, 4, and 6–16. The centering device C includes a central member 20 having a central opening 23 for receiving the pole P therethrough, an outer circular element 21, and a plurality of spacer elements 22 that extend radially between the central member 20 and the outer circular element 21, as seen in FIGS. 4, 6 and 7.

The centering device C is adapted to be positioned about the pole P and the outer circular element 21 is adapted to be connected to at least one of the generally annular rings 2. As shown in FIG. 4, in one embodiment of the present invention, the outer circular element 21 is connected to the lowermost ring 2, and the connection can be formed by any suitable means such as adhesives, mechanical fasteners such as staples, rivets or screws, or by inter-engaging portions provided between the generally annular rings 2 and the outer circular element 21.

The centering device C as shown in FIGS. 6–16 is configured from a plurality of elements that can be readily assembled and disassembled. Accordingly, the outer circular element 21 is configured from a plurality of arcuate elements 24 which are connected to one another in a manner to be described later to form the outer circular element 21. Each of the plurality of spacer elements 22 are also adapted to be removably connected to the central member 20 at one end thereof and to a respective arcuate element 24 at the other end thereof. Thus, the centering device can be easily assembled and easily disassembled for storage.

Figure 9:
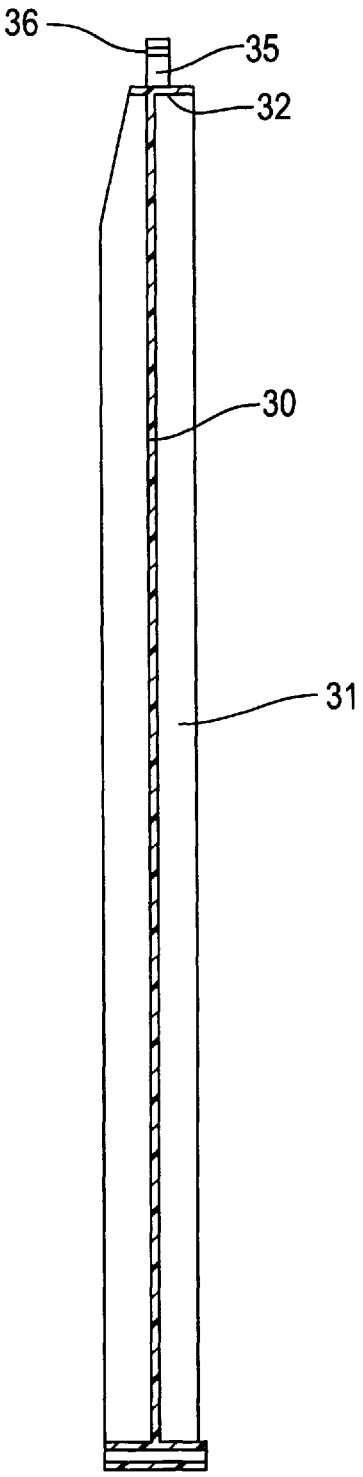
FIG. 9 is a side elevational view, partially in cross-section, of one spacer element which forms a portion of the centering device of the present invention.
Figure 10:
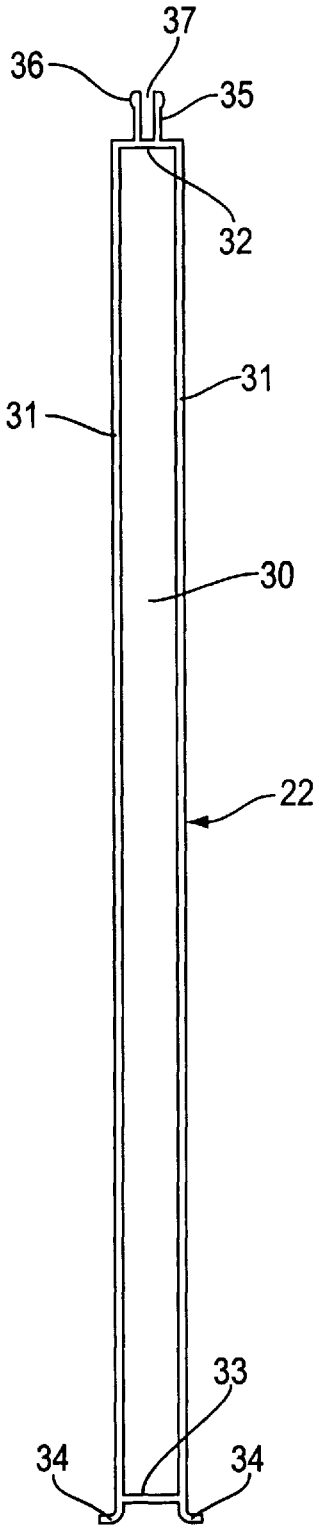
FIG. 10 is a top plan view of the spacer element of FIG. 9.

Turning to FIGS. 9 and 10, a spacer element 22 is depicted. Each spacer element 22 includes a central web 30, a pair of sidewalls 31 and end wall 33 at one end thereof having a pair of outwardly extending flange portions 34, and an end wall 32 at the other end thereof on which is mounted a projection 35 having a slot 37 and an outwardly protruding rib 36. The projection 35 is generally cylindrical in shape and includes a slot 37, and the rib 36 extends around the outer circumference of the projection 35 adjacent the outer end thereof. The opposite end of the spacer element 22 includes a pair of outwardly extending flanges 34, for purposes to be described later. The spacer element 22 may be formed of any suitable material, such as steel, aluminum, or synthetic plastic material. Additionally, the projection 35 can be configured to have any desirable shape, including rectangular, triangular, oval or round.

Figure 12:
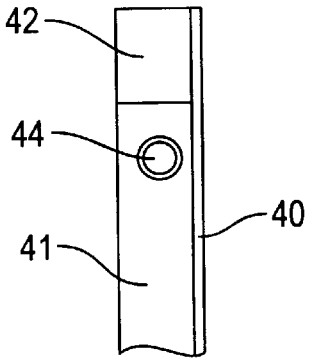
FIG. 12 shows a side elevational view of one end portion of the arcuate element of FIG. 11.
Figure 13:
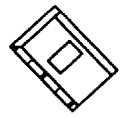
FIG. 13 shows a partial cross-sectional view of the arcuate element of FIG. 11 in the area of the offset portion shown in FIG. 11.
Figure 11:
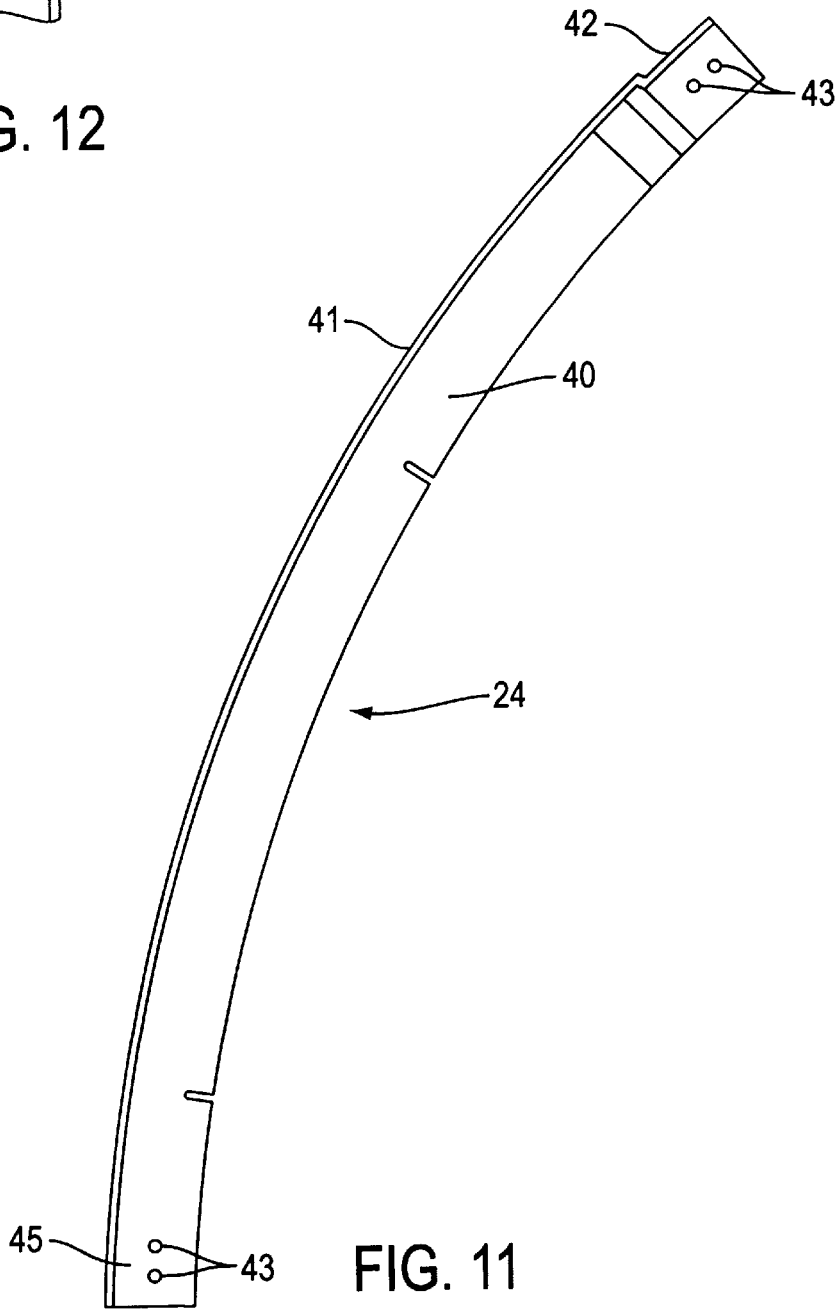
FIG. 11 is a bottom plan view of an arcuate element which forms a portion of a circular element of the centering device of FIG. 6.

Turning to FIGS. 11–13, one of the plurality of arcuate elements 24 is depicted therein. The arcuate elements 24 may be formed of any suitable material, such as steel, aluminum, or synthetic plastic material. Each arcuate element 24 is formed with an arcuate-shaped web portion 40 which is adapted to be connected to a ring of the tree element, and includes a downwardly extending arcuate wall 41 connected thereto. One end of the arcuate wall 41 has an offset portion 42 such that when an opposite end 45 of an adjacent arcuate element 24 is connected thereto, the sidewall 41 of the adjacent element engages the offset portion 42 to form a generally continuous outer circumference. Each end of the arcuate element 24 may be provided with apertures 43 for receiving fastening elements such as screws, bolts, rivets, etc., for connecting one arcuate element to another.

Furthermore, a generally circular aperture 44 is provided adjacent the end of the recessed portion 42 as seen in FIG. 12. The aperture 44 has a diameter that generally corresponds to the outer diameter of the projection 35 of spacer element 22, such that the projection 35 can be inserted therethrough, with the slot 37 permitting both sides of the projection 35 to deflect inwardly to permit the rib 36 to be pushed through the aperture 44 and then resiliently snap back into position to releasably connect the spacer element 22 to the respective arcuate element 24. Moreover, the aperture 44 may be configured to have any shape that corresponds with the shape of the projection 35 described above.

Figure 14:
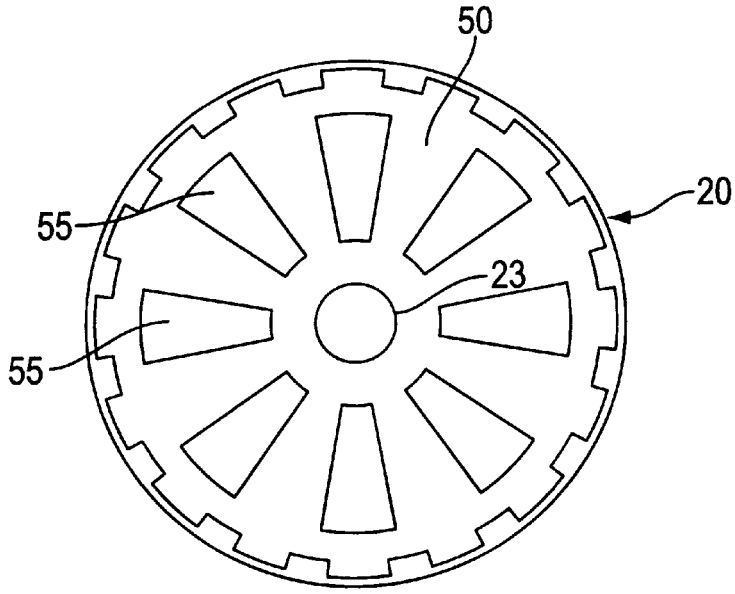
FIG. 14 shows a top plan view of a central member of the centering device of FIG. 6.
Figure 15:
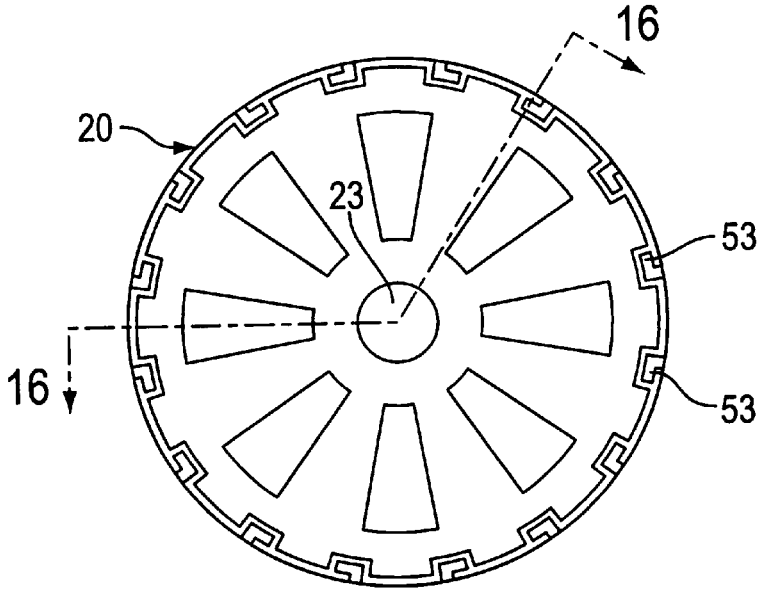
FIG. 15 shows a bottom plan view of the centering device.
Figure 16:
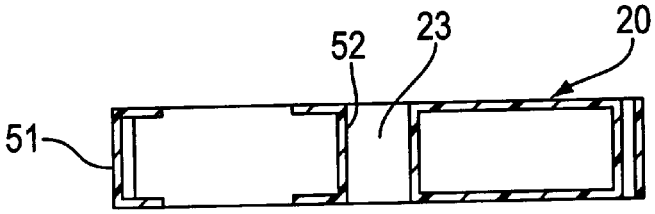
FIG. 16 shows a cross-sectional view of the central member of FIGS. 14 and 15.

The central member 20 is depicted in FIGS. 14–16 and may be formed of any suitable material, such as steel, aluminum, or synthetic plastic material. As seen in FIG. 14, the central member 20 is configured to have a generally circular upper surface 50 with a plurality of openings 55 and a central opening 23. As can be seen from FIG. 16, the central opening 23 is formed as a tubular hub portion 52. Central member 20 includes an outer peripheral wall 51 having a plurality of oppositely facing notches 53 formed therein for the receipt of the outwardly extending flanges 34 on the inner ends of the spacer elements 22. The notches 53 are configured to engage the outwardly extending flanges 34 of the spacer element 22 when the flanges 34 of the spacer element 22 are slidably inserted into the notches 53.

Furthermore, as can be seen from viewing FIGS. 6–16, the protrusion 35 of each spacer element 22 can be snapped into the aperture 44 of a respective arcuate element 24, then the opposite end of the spacer element having the outwardly extending flanges 34 of each spacer element may be inserted within a respective notch 53 of the central member 20 and thereafter the ends of the arcuate elements 24 can be secured together by fasteners in any appropriate manner. This results in a centering device having a generally wagon wheel shape and which can be readily assembled to engage the pole and a generally annular ring of the tree element to maintain the balance of the tree, yet can be readily disassembled and placed in a compact arrangement for storage.

In view of the above, it can be seen that the artificial tree of the present invention includes a tree element having a central generally disc-shaped member, a plurality of generally annular rings concentric to the central disc-shaped member and to one another such that the central disc-shaped member and the rings, in the operative position, are positioned in a vertically spaced, tiered array, with the central disc-shaped member at an uppermost position so that the tiered array is configured to have a tree-shape. A plurality of connecting strips connect each tier of the array to a next adjacent tier of the array, and the disc-shaped member, the concentric rings, and the connecting strips are formed from a unitary sheet of material by providing a plurality of discontinuous generally spiral slits in the sheet of material.

The tree may also include a central pole adapted to be fixed at one end to the disc-shaped member for supporting the tree element in an operative position, and the pole may be configured at one end with a pointed end which may be pushed into the ground. Alternatively, a stand having radiating legs and a central support member to receive the lower end of the pole may be provided for supporting the tree-shaped device in a conventional manner.

The tree may also include a centering device which is adapted to engage at least one of the rings and to cooperate with the pole to center a lower portion of the tiered array with respect to the pole to thereby maintain the balance of the tree.

Accordingly, the artificial tree of the present invention as set forth above can be quickly assembled, often in as little time as 30 seconds, by simply pulling the disc-shaped member spirally upwardly to form the vertically spaced tiered array, assembling the support pole, and supporting the pole in a stand or in the ground, with or without the centering device. When the tree is no longer needed for display, the pole, the centering device, and the tree element can be readily disassembled by merely reversing the assembly operations. Furthermore, upon disassembly, it can be seen that due to the collapsibility of the tree element into a generally sheet form and the ability of any support pole and centering device used therewith to be disassembled, the disassembled artificial tree of the present invention occupies a relatively compact space. Thus, the artificial tree of the present invention is also easy to store.

Although the above invention has been described with particular means, materials and embodiments, it is to be understood that the invention is not limited to the particulars disclosed and extends to all equivalence within the scope of the claims.

The present disclosure relates to subject matter contained in priority Hong Kong Design Application No. 9811619.3, filed Dec. 18, 1998, the disclosure of which is hereby expressly incorporated by reference thereto in its entirety and the priority of which is claimed under 35 U.S.C. § 119.

What is claimed:

1. A tree-shaped device comprising:

a central generally disc-shaped member;

a plurality of generally annular rings, said rings being concentric to said central disc-shaped member and to one another;

said central disc-shaped member and said rings being positioned in a vertically spaced, tiered array, with said central disc-shaped member at an uppermost position such that the tiered array is configured to have a tree-shape; and a plurality of connecting strips connecting each tier of the array to a next adjacent tier of the array; and wherein said disc-shaped member and said concentric rings are formed by providing a plurality of discontinuous generally spiral slits between said generally disc-shaped member and a next adjacent ring and between each respective adjacent ring to define the outer perimeters of said generally disc-shaped member and each said concentric ring except an outermost ring and also to define the inner perimeters of each said concentric ring, and said plurality of discontinuous slits further define said plurality of connecting strips.

2. A tree-shaped device according to claim 1, wherein the outer perimeter of each said ring in a lower next adjacent tier of the array is greater than that of the ring positioned there above.

3. A tree-shaped device according to claim 2, wherein the inner perimeter of each said ring in a lower next adjacent tier of the array is about the same dimension as the outer perimeter of the ring positioned there above.

4. A tree-shaped device according to claim 3, wherein said disc-shaped member and said concentric rings are formed from a unitary sheet of material.

5. A tree-shaped device according to claim 4, wherein said plurality of connecting strips are formed from a same unitary sheet of material from which said disc-shaped member and said concentric rings are formed.

6. A tree-shaped device according to claim 4, wherein said unitary sheet of material comprises a thin sheet of synthetic plastic material.

7. A tree-shaped device according to claim 4, wherein said unitary sheet of material comprises a thin circular sheet.

8. An artificial tree utilizing the tree-shaped device according to claim 1, further comprising a central pole adapted to be affixed at one end to said disc-shaped member for supporting said tree-shaped device is an operative position.

9. An artificial tree according to claim 8, wherein said pole is configured at one end to facilitate insertion into a support surface.

10. An artificial tree according to claim 8, further comprising a stand adapted to receive a lower end of said pole.

11. An artificial tree according to claim 8, further comprising a centering device adapted to engage at least one of said rings and to cooperate with said pole to center a lower portion of said tiered array with respect thereto.

12. An artificial tree according to claim 11, wherein said centering device further comprises a circular element for engagement with said lower portion of said tiered array, a central member for engaging said pole, and a plurality of spacer elements extending radially between said circular portion and said central member.

13. A blank for forming a tree-shaped device, said blank comprising:

a sheet of relatively rigid, resilient material;

said sheet provided with a plurality of generally concentric, spaced arrays of discontinuous generally spiral slits, said spaced arrays defining a central, generally circular disc-shaped member, a plurality of generally annular rings, and a plurality of spirally arranged hinge strips unitarily formed between adjacent ones of said generally disc-shaped member and each said generally annular ring, whereby said generally disc-shaped member and at least one of said generally annular rings are capable of being moved away from one another to form a vertically spaced tiered array with said hinge strips providing the spacing between the tiers of the tiered array.

14. A blank according to claim 13, wherein said sheet of relatively rigid, resilient material is formed as a thin, generally circular disc.

15. A blank according to claim 14, wherein said generally circular disc is formed from a sheet of synthetic plastic material.

16. A blank according to claim 13, wherein each slit of each said spaced array of spiral slits overlaps another slit of each said spaced array.

17. A method of making a display device, comprising:

providing a sheet of relatively rigid, resilient material;

providing said sheet with a plurality of generally concentric spaced arrays of discontinuous generally spiral slits to define a central, generally circular disc-shaped member, a plurality of generally annular rings, and a plurality of spirally arranged hinge strips between adjacent ones of said generally disc-shaped member and each said annular ring; and moving said generally disc-shaped member and at least one of said generally annular rings away from one another to form a generally conically shaped, vertically spaced tiered array.

18. A method according to claim 17, further comprising providing the slits in each said spaced array of spiral slits to overlap with at least one other slit in each said spaced array.

19. A tree-shaped device according to claim 1, wherein all surfaces of each connecting strip and each generally annular ring formed by said spiral slits being in the same spiral direction as said spiral slits.

20. A blank according to claim 13, wherein all surfaces of each connecting strip and each generally annular ring formed by said spiral slits being in the same spiral direction as said spiral slits.

* * * * *

UNITED STATES PATENT AND TRADEMARK OFFICE

CERTIFICATE OF CORRECTION

PATENT NO. : 6,200,656 B1
DATED : March 13, 2001
INVENTOR(S) : K.C. Tsang

It is certified that error appears in the above-identified patent and that said Letters Patent is hereby corrected as shown below:

Title page,
Item [30], Foreign Application Priority Data, "9811619" should be -- 9811619.3 --.
Item [56], References Cited, OTHER PUBLICATIONS, "Coillegiate" should be -- Collegiate --.

Signed and Sealed this

Ninth Day of April, 2002

*Attest:*

*Attesting Officer*

JAMES E. ROGAN
*Director of the United States Patent and Trademark Office*